US005199327A

United States Patent [19]

Stevenson

[11] Patent Number: 5,199,327

[45] Date of Patent: Apr. 6, 1993

[54] UNITARY TOOL FOR REMOVING AND INSTALLING RADIATOR CAPS

[76] Inventor: Robert L. Stevenson, 7320 W. 87th St., Overland Park, Kans. 66212

[21] Appl. No.: 795,937

[22] Filed: Nov. 15, 1991

Related U.S. Application Data

[63] Continuation-in-part of Ser. No. 655,551, Feb. 12, 1991, Pat. No. 5,161,436.

[51] Int. Cl.[5] ..... B67B 7/00

[52] U.S. Cl. ..... 81/3.41; 81/3.15; 220/DIG. 32

[58] Field of Search ..... 81/3.41, 3.09, 3.07, 81/3.15, 3.4, 3.42, 176.1, 176.15, 176.2, 176.3, 64, 125, 157, 158; 220/DIG. 32, 260; 16/126, 114 R; 215/296, 305

[56] References Cited

U.S. PATENT DOCUMENTS

| | | | |
|---|---|---|---|
| 769,132 | 8/1904 | Graham | 215/295 |
| 1,733,355 | 10/1929 | Morse | 81/176.2 |
| 1,882,462 | 10/1932 | Weber | 81/176.2 |
| 3,014,389 | 12/1961 | O'Hara | 81/90 |
| 3,048,067 | 8/1962 | Miles et al. | 81/3.1 |
| 3,094,022 | 6/1963 | Young | 81/176.3 |
| 3,186,263 | 6/1965 | Grote | 81/3.1 |
| 3,262,247 | 7/1966 | Scholle | 53/317 |
| 3,274,864 | 9/1966 | Chapman | 81/90 |
| 3,638,515 | 2/1972 | Lentz et al. | 81/3.1 R |
| 3,837,242 | 9/1974 | Harper | 81/3.1 R |
| 3,885,477 | 5/1975 | Shook | 81/3.1 R |
| 4,697,480 | 10/1987 | Robideau | 81/3.4 |
| 4,846,025 | 7/1989 | Keller et al. | 81/3.09 |
| 4,914,895 | 4/1990 | Proctor | 81/3.4 |
| 5,003,845 | 4/1991 | Roy et al. | 81/3.4 |

FOREIGN PATENT DOCUMENTS

| | | | |
|---|---|---|---|
| 0095014 | 6/1922 | Switzerland | 215/305 |
| 0001268 | of 1881 | United Kingdom | 215/305 |

*Primary Examiner*—Roscoe V. Parker
*Attorney, Agent, or Firm*—Kenneth W. Iles

[57] ABSTRACT

A radiator cap loosening and removal tool includes a generally U-shaped handle pivotally attached to a base, which is in turn fastened to the depending skirt portion of a radiator cap by self-tapping sheet metal screws. An alternative embodiment comprises a U-shaped handle whose legs embrace the skirt of the radiator cap and are pivotally fastened thereto by screws or rivets. Another alternative embodiment comprise a crossbar fastened to the skirt of a radiator cap by threaded fasteners, which serve as pivots for a U-shaped handle.

8 Claims, 4 Drawing Sheets

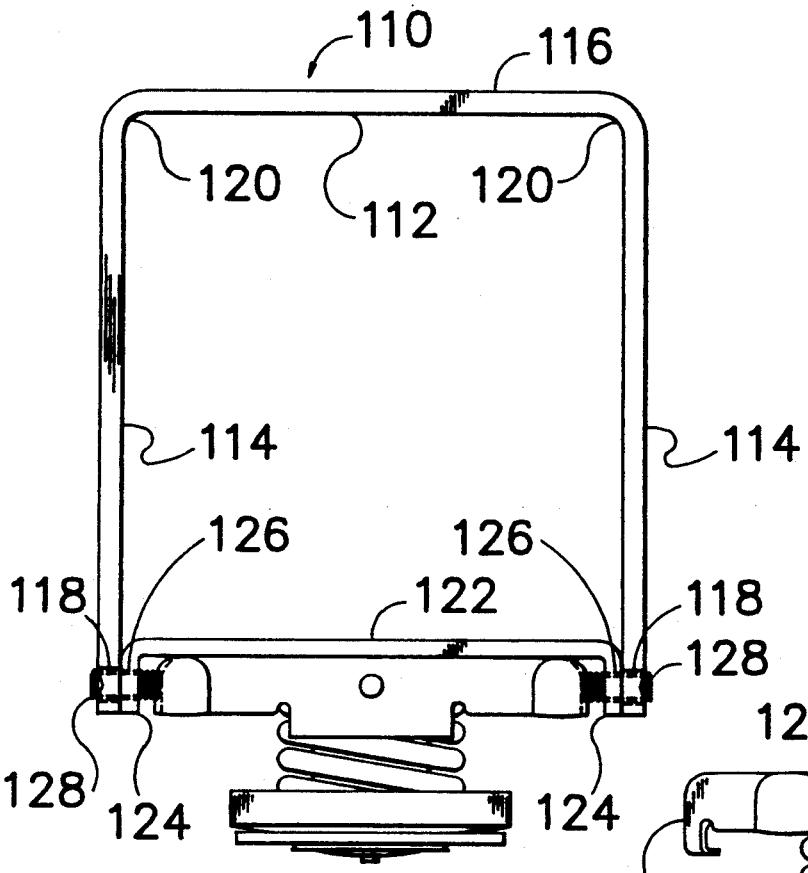
FIG.14
FIG.15
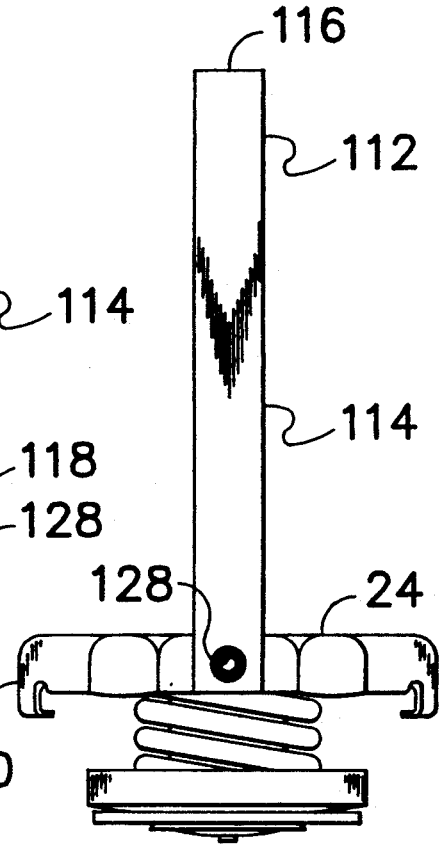
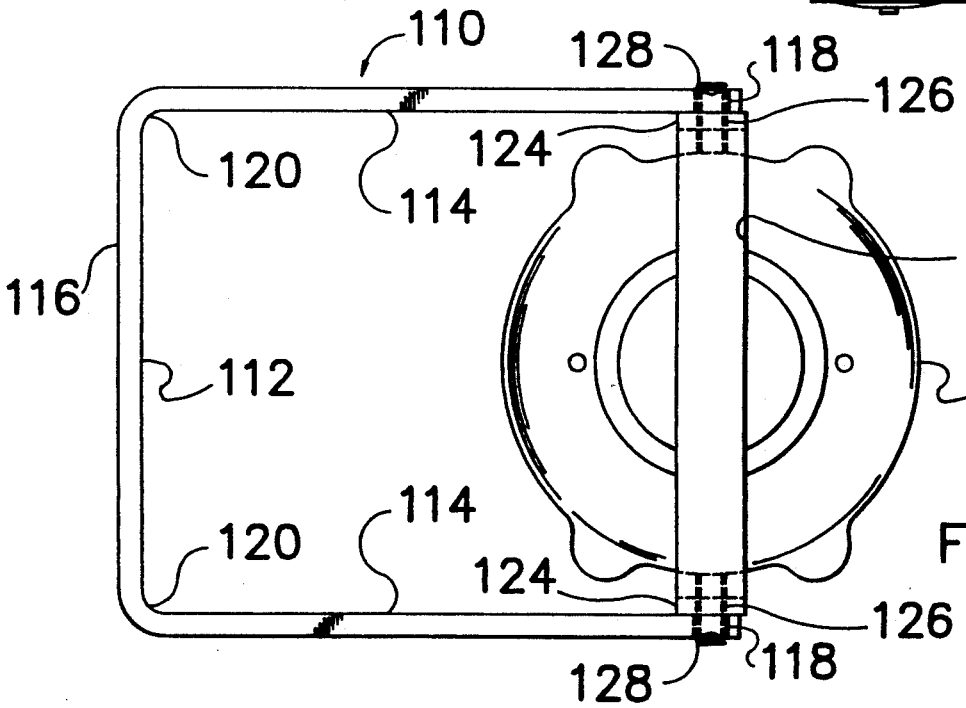
FIG.16

UNITARY TOOL FOR REMOVING AND INSTALLING RADIATOR CAPS

CROSS-REFERENCE TO RELATED APPLICATIONS

This application is a Continuation-In-Part of U.S. Pat. No. 5,161,436, issued Nov. 10, 1992 from application Ser. No. 07/655,551, filed Feb. 12, 1991.

BACKGROUND OF THE INVENTION

1. Field of the Invention

This invention relates to tools for removing engine radiator caps. In particular, the invention relates to a tool, that without modification, fits all different styles of engine radiator caps, including automobile, truck, and stationary engines, among others.

2. Description of Related Art Including Information Disclosed under 37 C.F.R. Sections 1.97–1.99

The prior art reveals numerous radiator cap removal tools. Many such tools are deficient because they are not suitable for use with all styles of radiator caps. In addition, use of such tools may place the user's hand so close to the radiator cap that hot fluid is likely to spray the hand when removing the radiator cap from a hot radiator. Many such tools cannot be used on radiator caps that are not mounted on the top of the radiator. If they are not kept in the car, truck, or near a stationary engine at all times, they may not be available when the radiator overheats or it is desired to remove the radiator cap for other purposes, such as routine filling or other service work.

Some of these tools enable the user to loosen the radiator cap, but do not allow the same tool to be used in actually removing the radiator cap from the radiator filler neck. A separate tool, such as a pair of pliers or a rag, which are often unavailable at the moment of need, is needed for actually removing the hot radiator cap.

Furthermore, all such tools are easily misplaced simply because they are used so infrequently that the owner does not keep them with the vehicle, or easily recall where he left them. Finally, many such tools are awkwardly shaped and accordingly, unwieldy in use and wholly unsuitable for permanent installation.

Furthermore, most modern automobile radiators are equipped with a coolant recovery system that collects and condenses vapors escaping from the radiator during operation of the engine. The condensed fluids are returned to the radiator and engine cooling system by ambient air pressure that exceeds the fluid pressure inside the cooling system when the engine cools. When such coolant recovery system is employed, the radiator cap typically is designed to be loosened by turning about one-quarter turn counterclockwise, where it engages a pressure release stop-tooth on an outer flange of the radiator filler neck. When the radiator cap is in this position, vapor pressure will be released from the radiator and cooling system, but the cap cannot be removed from the radiator filler neck, thereby reducing the chance of injury from splashing hot fluid. After the cooling system pressure reaches equilibrium with the ambient air pressure, the radiator cap can be safely removed by depressing it firmly and rotating it approximately another one-half turn counterclockwise, allowing the radiator cap to be lifted free of the filler neck.

Most tools for removing radiator caps, including the human hand, require the user to press down hard on the radiator cap to develop a sufficient grip to overcome the friction between the radiator cap gasket and the lip of the filler neck and to rotate the radiator cap. When the radiator cap is thus depressed, it is easy, and all too common, to rotate the radiator cap past the pressure release stop-tooth. If this happens and the radiator is hot, the cap is likely to be explosively thrown from the radiator as superheated fluids gush out of the radiator filler neck, and injury to the person is very likely. Such injuries can be very serous and may include, for example, the loss of sight. In addition, exposure to antifreeze can dangerously damage a vehicle's finish.

Most modern vehicles have little spare room in the engine compartment, with the engine and ancillary equipment virtually stuffed into the engine compartment. Often, the radiator cap is mounted in a manner or location that is difficult to reach, or if it can be easily reached, it may be difficult to apply enough force to remove the cap because of the curve of the wrist that the mechanic must assume to reach the cap.

Attempts to overcome these problems have led to many prior patents. Many are directed to devices for attempting to prevent burns either from the splashing of hot fluids onto the user or simply from touching hot parts, and are consequently fairly large tools that cannot be left in place on the radiator cap. Examples of this type of tool are found in U.S. Pat. Nos. 5,003,845; 4,914,985; 4,697,480; 3,885,477; 3,837,242; 3,638,515; 3,274,864; 3,186,263; 3,048,067; and 3,014,389. The possibility of not having tools such as these available when needed is quite high, especially for the ordinary motorist.

Therefore, a need exists for a tool for removing radiator caps that can be used without modification for all styles of radiator caps; that will permit convenient removal a radiator cap that is not mounted on the top of the radiator; that is easy to use; that will not become lost; that is always available when needed; that can easily be used for actually removing the radiator cap from the radiator neck, as well as for loosening it; and that is simple and inexpensive to design, manufacture and to install.

SUMMARY OF THE INVENTION

It is, therefore, a primary object of the present invention to provide a tool for loosening and removing a radiator cap that can be used without modification to remove any style of radiator cap by providing a tool for removing radiator caps comprising a base plate having two base plate legs and two upwardly protruding opposed ears, with each ear including an aperture therethrough; a generally U-shaped bail or handle including two depending handle legs connected by a connecting portion of the U-shaped bail or handle and each said leg includes an aperture; said legs of said U-shaped bail or handle pivotally fastened to said base plate by pins and a means for attaching said base plate legs to a radiator cap.

In another embodiment, the tool for removing radiator caps consists of a unitary radiator cap and tool for removing the radiator cap from a radiator filler neck comprising a generally U-shaped bail or handle having a pair of depending legs connected by a connecting portion, each leg including an aperture; a radiator cap having two apertures through the outer depending skirt portion of the radiator cap, with the apertures being opposite one another; two gripping mechanical fasteners penetrating said apertures in said legs, and said apertures in said skirt. The fasteners may be rivets, cotter pins, screws and nuts, or other suitable fasteners.

It is a further object of the present invention to provide a tool for removing radiator caps as aforesaid, that can be easily used with radiator caps that are not mounted on the top of the radiator.

It is still another object of the present invention to provide a tool for removing radiator caps as aforesaid, that is easy to use.

It is another object of the present intention to provide a tool for removing radiator caps as aforesaid that is not likely to become lost.

It is another object of the present invention to provide a tool for removing radiator caps as aforesaid that is always available when needed and can be permanently installed on a radiator cap, either before or after purchase of the cap by the end user.

It is still another object of the present invention to provide a tool for removing radiator caps as aforesaid comprising a tool that will enable a user to rotate a radiator cap to the pressure release position without a danger of rotating it past that position unintentionally, and to remove the loosened radiator cap from the radiator filler neck after any pressure in the cooling system has been released, without the user needing to touch the radiator cap.

It is another object of the present invention to provide a tool for removing radiator caps as aforesaid that is simple and inexpensive to design and manufacture.

It is another object of the present invention to provide a tool for removing radiator caps that will be left in place on the radiator cap when the hood of a vehicle is closed.

These and other objects of the present invention are achieved by providing, in all embodiments, a handle pivotally connected to the depending skirt portion of a radiator cap by mechanical fasteners or the like that permit the handle to pivot from an upright position perpendicular to the plane of the radiator cap to a lowered position roughly parallel to the plane of the radiator cap. The radiator cap can be installed and removed easily when the handle is in the upright position, and the hood of a vehicle can be lowered easily when the handle is in the lower position. The tool can be installed permanently and the tool and radiator cap combination can be produced and sold as a single unit, or the tool can be sold separately for installation by the consumer. The handle may be attached directly to the radiator cap, or may be used in connection with different styles of a base or crossbar that lies across the top of the radiator cap and reenforces the entire tool. In any case, the handle includes a pair of opposed depending legs and is pivotally connected to the radiator cap by rivets, or gripping mechanical fasteners, or the like.

Other objects and advantages of the present invention will become apparent from the following description taken in connection with the accompanying drawings, wherein is set forth by way of illustration and example, the preferred embodiments of the present invention and the best mode currently known to the inventor for carrying out the invention.

BRIEF DESCRIPTION OF THE DRAWINGS

FIG. 14 is a front elevation of another alternative embodiment of the tool for removing radiator caps with the handle shown in the upright position.

FIG. 15 is a side elevation of the tool shown in FIG. 14.

FIG. 16 is a top plan of the tool shown in FIGS. 13, 14 shown with the handle in the lowered position parallel the surface of the radiator cap.

DETAILED DESCRIPTION OF THE PREFERRED EMBODIMENTS

As required by the Patent Statutes and case law, the preferred embodiments of the present invention and the best mode currently known to the inventor for carrying out the invention are disclosed in detail herein. It is, however, to be understood that the disclosed embodiments are merely illustrative of the invention, which may be embodied in various forms. Therefore, specific structural and functional details disclosed herein are not to be interpreted as limiting, but merely to provide the proper basis for the claims and as a representative basis for teaching one skilled in the art to employ the tools for removing radiator caps disclosed herein in virtually any appropriately specific and detailed structure.

Figure 1:
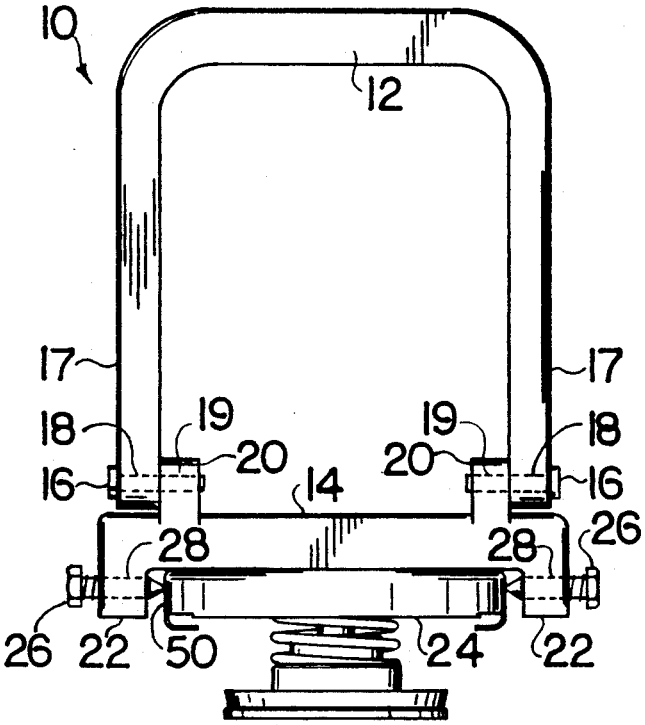
FIG. 1 is a front elevation of a preferred embodiment of the tool for removing radiator caps shown with the handle shown in an upright position.

Referring to FIG. 1, there is shown generally a tool for removing radiator caps 10, including a U-shaped bail or handle 12 having a pair of depending legs 17 that straddle a pair of opposed ears 20 which are attached to a base plate 14 by pins 16 or other suitable fasteners that penetrate apertures 18 in the U-shaped bail or handle 12 and apertures 19 in the two ears 20, which comprise a portion of the base plate 14. The ears 20 are upward projecting well-defined perpendicular protuberances (as viewed in FIG. 1) that are integrally formed in the base plate 14. Alternatively, the ears 20 may be separately fashioned pieces that are attached to the base plate 14 by gluing, fusing, or other suitable means. This means for pivotally connecting the bail or handle 12 to the base plate 14 allows for the bail or handle 12 to pivot approximately 180 degrees about the axis of a plurality of pins 16. See FIG. 3, which illustrates the tool 10 with the bail 12 in the down or lowered position. Naturally, screws and nuts, rivets, cotter pins, or any other suitable fasteners may be employed to join the handle 12 to the ears 20.

A pair of opposed base plate legs 22 depend from the principal plane of the base plate 14 and straddle the outside perimeter of the radiator cap 24, which defines a depending skirt portion 50. Self-tapping sheet metal screws 26 are inserted through apertures 28 in the base plate legs 22 and are tightened until they grip the radiator cap 24 firmly. It is not necessary to tap the apertures 28 when self-tapped screws are used. If desired, the outer lip or skirt portion 50 of the radiator cap 24 may be dented with a center punch and hammer, or other machines to allow the screws 26 to grip the radiator cap 24 tightly with greater ease. Alternatively, the base plate legs 22 may be attached or fastened to the depending outer skirt 50 of the radiator cap 24 by a suitable adhesive such as an epoxy.

Figure 2:
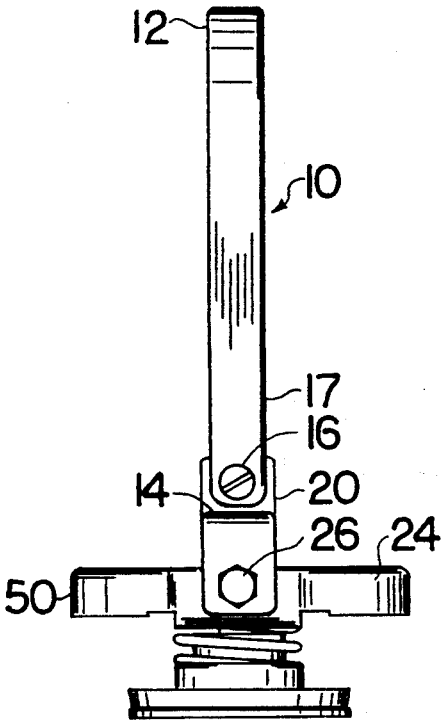
FIG. 2 is a side elevation of the device shown in FIG. 1.
Figure 3:
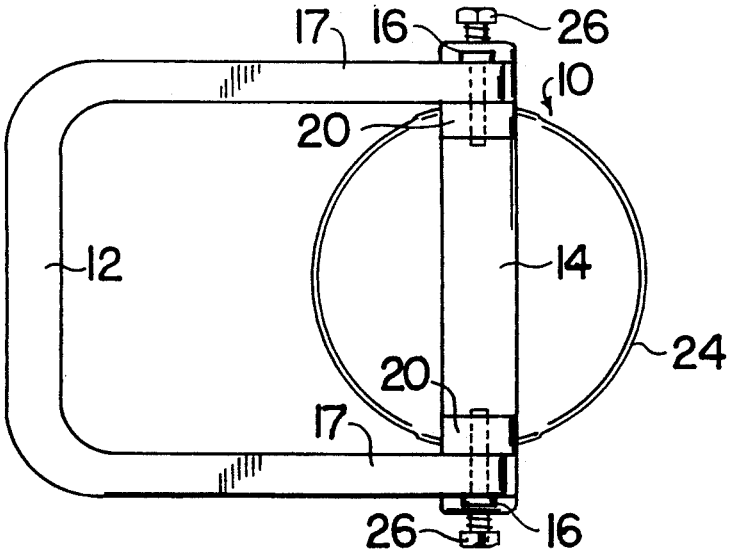
FIG. 3 is a plan view of a tool for removing radiator cap according to the present invention shown with the handle in the down position.
Figure 4:
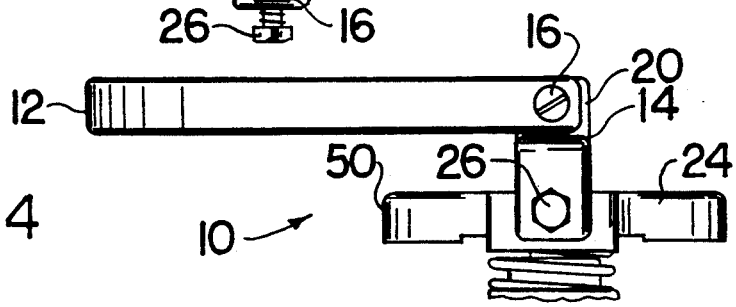
FIG. 4 is a side elevation of the device shown in FIG. 3.

The tool 10 is also illustrated in FIGS. 2, 3, and 4 for the purpose of providing a clear three dimensional depiction of the tool 10. FIG. 3 shows the tool 10 in the relaxed or non-use position, that is, with the U-shaped handled 12 in the lowered position, which allows the hood of the car or other vehicle to be closed without interference from the tool 10. In some applications, it may be necessary or desirable to use the tool in this position, but normally the handle 12 will be in the upright position, or near to it, in use, as shown in FIGS. 1, 2. It is intended that the tool 10 will not be removed from the radiator cap 24 after installation, but will remain in place permanently. Naturally, it is also possible to manufacture a radiator cap and attached removal tool 10 as a single unit for sale as original equipment manufacture or for the replacement after market.

The U-shaped handle 12 and the base plate 14 may be conveniently made from polyvinylchloride, which is an excellent material for the intended use of the tool 10, because polyvinylchloride is a good heat insulator; has a very low specific heat capacity; and has a very low coefficient of expansion. Alternatively, the U-shaped handle 12 may be made of any suitable plastic, steel, heavy gauge wire or rods, or any other suitable material. Further, the U-shaped handle 12 may be manufactured in a variety of shapes, such as semi-circular, rectangular, and so forth, that allows the shape to be used as a handle and to swing or pivot about the axis of the pins 16 or any axis in the plane of the radiator cap 24.

Figure 5:
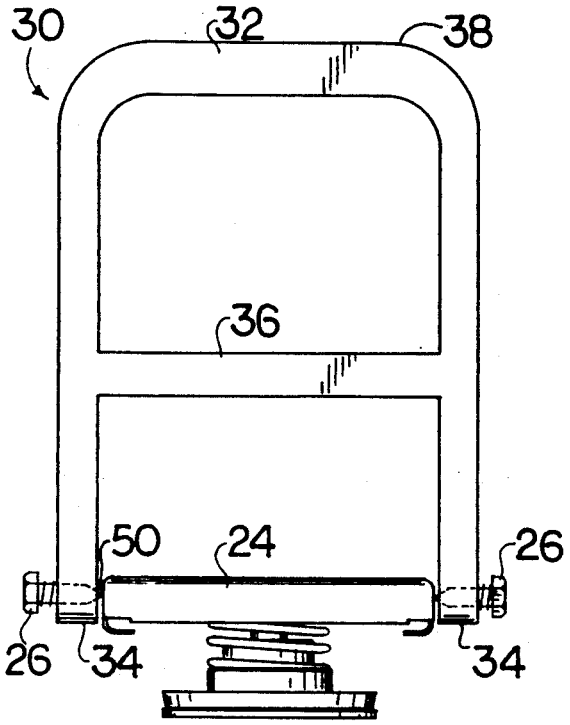
FIG. 5 is a front elevation of an alternative embodiment of the tool for removing radiators caps.

Referring to FIG. 5, there is shown an alternative embodiment of the tool for removing radiator caps, shown generally at 30, and comprising a U-shaped bail or handle 32, whose open ends straddle the perimeter portion of the radiator cap 24 at two points opposite from one another and in the case of a circular radiator cap, along a diameter, where they are held in place by self-tapping sheet metal screws 26 in the manner described above, about which the handle 32 pivots. A brace 36 is fixed to the U-shaped handle 32 at a position intermediate or between the open ends 34 of the handle 32 and a top portion 38 of the U-shaped handle 32. The brace 36 may be fastened to the U-shaped handle 32 by any convenient means such as adhesives, fusing, gluing, or by mechanical fasteners such as screws. The preferred embodiment illustrated in FIG. 5 may also be made for polyvinylchloride or any other convenient material.

Figure 6:
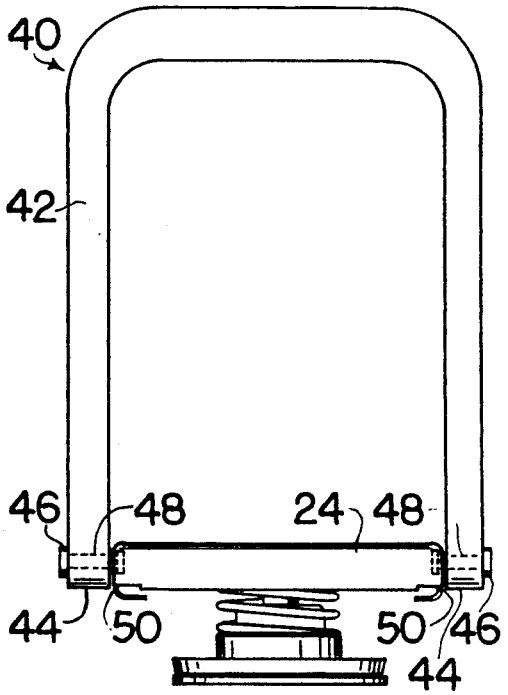
FIG. 6 is a front elevation of another embodiment of the tool for removing radiator caps.

Referring to FIG. 6, there is shown yet another preferred embodiment of a tool for removing radiator caps, shown generally at 40, and comprising a U-shaped bail or handle 42 having a pair of legs 44 that straddle the radiator cap 24. The tool 40 is fastened to the outer perimeter of the radiator cap 24 by rivets 46 that penetrate a pair of opposed aligned apertures 48 in the legs 44 and that penetrate the outer skirt 50 of the radiator cap 24. The handle 12 pivots on the rivets 46. The heads of the rivets 46 are then flattened so that the tool 40 becomes an integral portion of the radiator cap 24, and is designed to be left on the radiator cap 24 permanently. The embodiment shown in FIG. 6 comprises a unitary combination radiator cap and removal tool which may conveniently be manufactured and sold as a single unit.

Any of the embodiments disclosed herein may be permanently attached to a radiator cap by using rivets or other fasteners that penetrate the outer skirt 50 of the radiator cap 24 to provide a permanent installation of the tool on a radiator cap 24. The tool 40 may be made of polyvinylchloride or other appropriate material.

In use with any of the embodiments disclosed herein, typically, the user swings or pivots the bail or handle of the tool to an upright position, or a position roughly perpendicular to the plane of the top of radiator cap 24, and turns the bails or handle, and therefore, the radiator cap, counterclockwise while not exerting significant downward force on the tool or the radiator cap. This allows the radiator cap to be moved to the vent position, without any risk of turning the radiator cap so far that it is blown off the radiator. After the pressure inside the engine cooling system has come to equilibrium with the atmospheric pressure, the user may press down firmly on the handle of the tool for removing radiator caps in order to depress the outer skirt 50 of the radiator cap 24 enough to allow the radiator cap 24 to be rotated past the stop-tooth on the outer flange of the radiator filler neck, and disengaging the threads that retain the radiator cap on the filler neck.

The then user continues turning the radiator cap counterclockwise until it is unscrewed from the radiator filler neck, which takes very little downward force. Then, using the bail or handle of the tool, the user lifts the cap free of the radiator filler neck and sets it aside, providing unobstructed access to the radiator filler neck. The radiator cap may be reinstalled by reversing this procedure. If the radiator and radiator cap have cooled sufficiently, the radiator cap can be reinstalled without using the tool, which can be held out of the way while the radiator cap is being installed, without having to remove it from the radiator cap. All embodiments of the invention disclosed herein can be operated in this manner.

Figure 7:
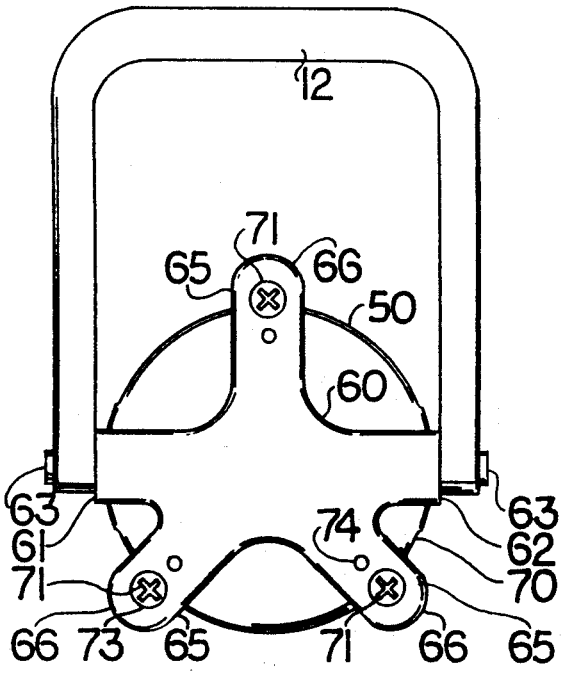
FIG. 7 is a plan view of another alternative embodiment of the radiator cap removal tool.
Figure 8:
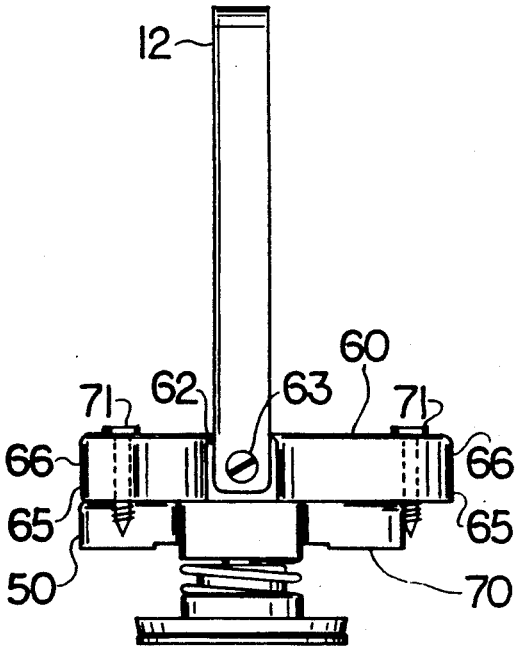
FIG. 8 is a side elevation of the radiator cap removal tool shown in FIG. 7.

Two other alternative embodiments of the radiator cap removal tool are shown in connection with FIGS. 7–13. In FIGS. 7 and 8, the same bail or handle 12 as described in connection with FIG. 1 is employed, but the base plate is different. In this embodiment, a star-shaped base 60 is attached at diametrically opposed arms 61 and 62 to the ends of the bail or handle 12 by pivots 63. Arms 65 extends triangularly outwardly and terminate in the tips 66 protruding beyond the margins of any underlying radiator cap, such as the cap 70. Cap engaging screws 71 extend through the arms 65 adjacent to the tips 66 and are selectively positioned in either of two sets of holes 73 and 74 to accommodate radiator caps 70 of either of two diameters. The screws 71 may be longitudinally flattened, with threads ground off for rotational adjustment and engagement with the skirts 50 of different sizes of radiator caps 70. This style of radiator cap removal tool is particularly useful the radiator caps that are circular and do not have projecting legs or ears which would facilitate gripping by hand.

Figure 9:
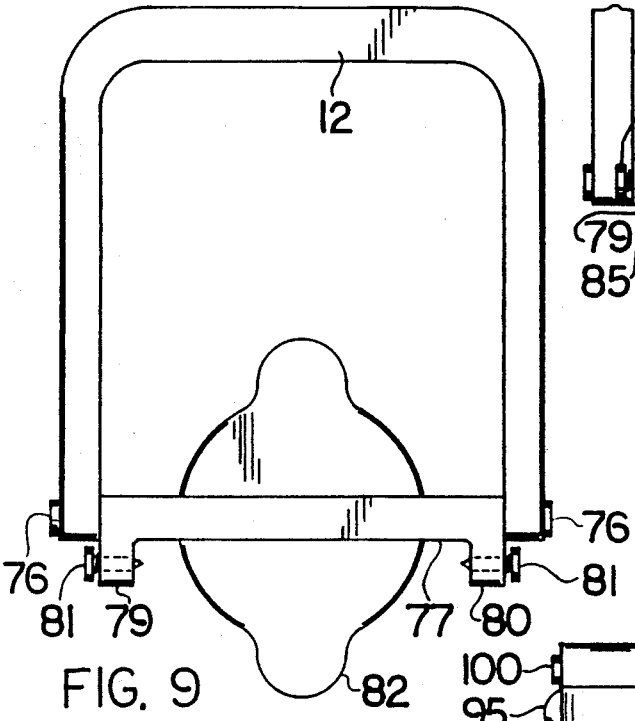
FIG. 9 is a plan view of another alternative embodiment of the radiator cap removal tool.
Figure 10:
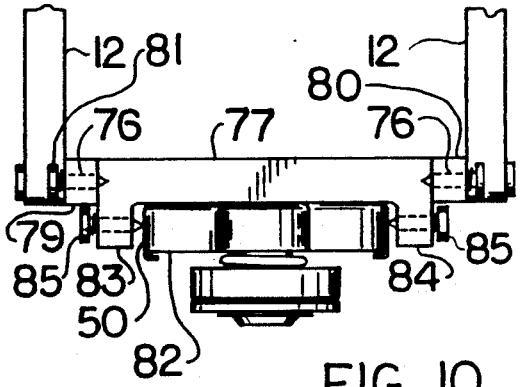
FIG. 10 is a side elevation of the embodiment shown in FIG. 9.

Another embodiment of radiator cap removal tool is shown in FIGS. 9 and 10, wherein a bail or handle 12 is connected by a pair of pivots 76 to a crossbar 77. Looking down on the radiator cap, as shown in FIG. 9, a pair of opposed ears 78 and 80 project laterally from the crossbar 77 and have cap engaging screws 81 extending through the ears 78, 80 in opposed confronting relation. These screws 81 then engage a cap 82 therebetween, the cap 82, of course, being rotated 90 degrees in the plane of the paper from the orientation illustrated in FIG. 9.

Figure 12:
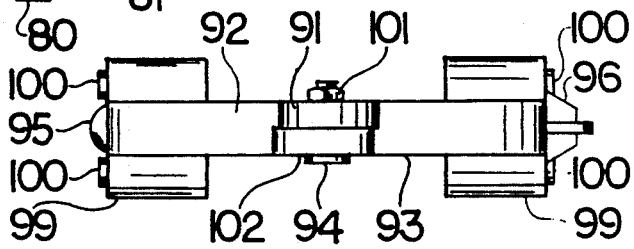
FIG. 12 is a top plan of the tool shown in FIG. 11 with the handle in an upright position.
Figure 11:
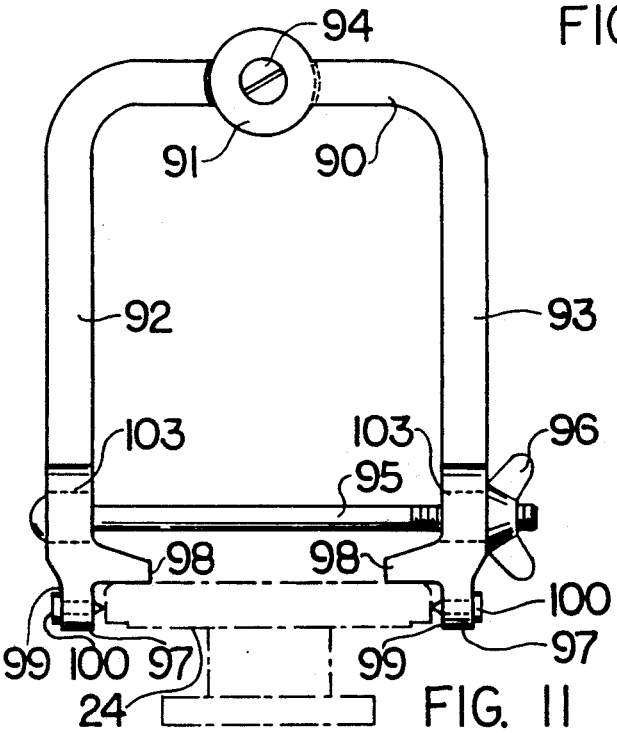
FIG. 11 is a front elevation of a another alternative embodiment of the tool.
Figure 13:
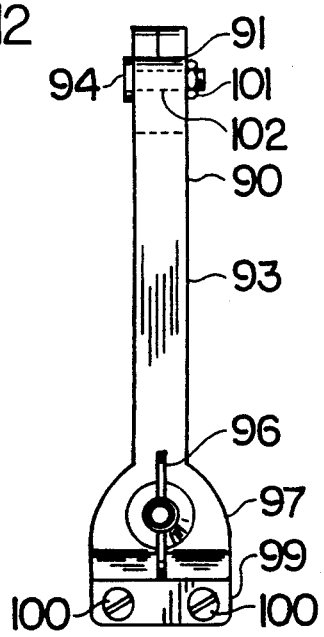
FIG. 13 is a side elevation of the tool shown in FIG. 11.

Another embodiment is shown in FIGS. 11 through 13 in which the handle or bail 90 has an upper pivot connection 91 permitting a pair of opposed depending arms 92 and 93 to be swung toward and away from each other. A screw 94 and nut 101 or other fasteners are used to provide an axis for the pivot connection 91 through the apertures 102. A bolt 95 extends between each of the handle arm ends 97, penetrating the apertures 103 in the arm ends 97 above and adjacent to the lips 98 and is secured by a wingnut 96, which allows the removal tool to be tightened on or removed from the radiator cap 24. At each of the arm ends 97 is formed a lip 98 which bears against the upper surface of a radiator cap and joins an ear 99 through which a screw 100 having a pointed end projects for engagement with the skirt of the radiator cap 24. As shown in FIG. 13, two screws 100 are used on each ear 99 for additional frictional engagement. Rivets or the like can naturally also be used in place of the screws 100 in this embodiment. In either case, the screws or fasteners 100 are fixedly inserted through the apertures in the arm ends 97 to insure a firm grip on the radiator cap 24.

Use of these radiator cap removal tools as shown in FIGS. 11–13 is consistent with the use of the other embodiments disclosed herein, as described above.

Referring to FIGS. 13–16, there is shown the preferred embodiment of the radiator cap removal tool 110. A handle 112 comprises a substantially U-shaped handle having a pair of opposed depending legs 114 at about 90 degrees to a top portion 116 of the handle 112. Adjacent to the lower end of each of the two legs 114 is an aperture 118. The handle 112 is preferably made of a single piece of steel bar stock of suitable dimensions by bending it to produce two bends 120 of about 90 degrees each. A crossbar 122 includes two short downward projecting crossbar legs 124 preferably formed by bending the crossbar 122 at 90 degrees adjacent to each end of the crossbar 122. The resulting crossbar legs 124 are parallel and opposed to one another. Adjacent to the lower end of each crossbar leg 124 is a threaded aperture 126. The crossbar 122 straddles the top of the radiator cap 24, with the legs 124 aligned with the depending outer skirt 50. One screw 128, such as an Allen screw, or other gripping mechanical fastener, is threaded into each of the apertures 126. The bends 120 in the handle 112 are somewhat smaller than 90 degrees, so that the depending legs 114 are not quite parallel in unstressed equilibrium, but rather are closer together at the bottom ends near the apertures 118 than at the top portion 116. The apertures 118 in the handle 112 are very slightly larger in diameter than the screws 128. The handle 112 is mounted on the crossbar 122 by aligning the apertures 118 with the matching threaded apertures 126 of the crossbar 122. Then the screws 128 are threaded into the threaded apertures 126, while also penetrating the unthreaded apertures 118. The handle 112 is then free to pivot about an axis defined by the screws 128 and is held in firm engagement with the crossbar 122 by the compressive spring tension of the handle 112, which is produced by forcing the angles of the bends 120 to become larger, at about 90 degrees. The screws 118 are tightened against the depending outer skirt 50 of the radiator cap 24 to provide firm engagement between the radiator cap 24 and the tool 110. The exact dimensions of the tool 110 will naturally be designed to accommodate the desired sizes of radiator caps. The tool 112 can be installed on a radiator cap either before or after the cap is sold and it may be used for permanent or temporary installation. It is to be understood that while certain forms of this invention have been illustrated and described herein, the invention is not limited thereto, except insofar as such limitations are included in the following claims.

What is claimed and desired to be secured by Letters Patent is as follows:

1. A tool for removing and installing a radiator cap from a radiator cap filler neck, comprising:

a. a handle having a pair of opposed legs, each said leg having a top portion including a connecting aperture and a lower end having at least one first aperture, with both said legs pivotally connected to each other at said top portion aperture;

b. said lower end of each said leg further comprising a second aperture adjacent to and above said first aperture:

c. a bolt inserted through each of said second apertures and secured with an adjustable fastening means; and e. means through said at least one first aperture for gripping said depending skirt portion of said radiator cap.

2. A tool according to claim 1 wherein said gripping means comprises a mechanical fastener fixedly inserted through each of said first apertures in opposing relationship.

3. A tool according to claim 2 wherein said handle further comprises a lip on each said leg of said handle between each said first aperture and each said second aperture for engaging the upper surface of a radiator cap.

4. A unitary radiator cap and tool for removing and installing said radiator cap, comprising:

a. a radiator cap having a depending skirt portion;

b. a handle having a pair of opposed legs, each said leg having a top portion including a connecting aperture and a lower end having at least one first aperture, with both said legs pivotally connected to each other at said top portion aperture;

c. said lower end of each said leg further comprising a second aperture adjacent to and above said first aperture;

d. a bolt inserted through each of said second apertures and secured with an adjustable fastening means; and e. means through said at least one first aperture for gripping said depending skirt portion of said radiator cap.

5. A tool for removing and installing a radiator cap on the filler neck of a radiator, comprising:

a. handle comprising a top portion and a pair of opposed depending legs, each said leg having a lower end further comprising a first aperture therethrough;

b. a crossbar further comprising one short downward projecting crossbar leg at each end of said crossbar, and a second aperture in each said crossbar leg; and c. one mechanical fastener inserted through one said first aperture and one said second aperture when said one first and second apertures are aligned and one mechanical fastener inserted through the other said first aperture and the other said second aperture when said other apertures are aligned, whereby said legs and said crossbar legs are aligned, and said mechanical fasteners extend inwardly of handle legs.

6. A tool as claimed in claim 5 wherein said second apertures further comprise threaded apertures and said mechanical fasteners further comprise screws.

7. A unitary radiator cap and tool for removing and installing the radiator cap on the filler neck of a radiator comprising:

a. a radiator cap further comprising a depending skirt portion;

b. handle comprising a top portion and a pair of opposed depending legs, each said leg having a lower end comprising one first aperture therethrough;

c. a crossbar comprising one short downward projecting crossbar leg at each end of said crossbar, and one second aperture in each said crossbar leg; and d. one mechanical fastener inserted through one said first aperture and one said second aperture when said one first and second apertures are aligned and one mechanical fastener inserted through the other said first aperture and the other said second aperture, whereby said legs and said crossbar legs are aligned, said mechanical fasteners extending inwardly of handle legs and said fasteners frictionally engage said skirt of said radiator cap.

8. A radiator cap and tool as claimed in claim 7 wherein said first apertures are larger in diameter than said second apertures, said second apertures are threaded, and said mechanical fasteners are threaded into said second apertures and frictionally engage said radiator cap skirt and said handle is pivotally held in place on said fasteners by compressive tension tending to force said lower ends of said handle legs inward toward said radiator cap.

* * * * *